US006556173B1

(12) United States Patent
Moustakas et al.

(10) Patent No.: US 6,556,173 B1
(45) Date of Patent: Apr. 29, 2003

(54) INTEGRATED MULTIPORT ANTENNA FOR ACHIEVING HIGH INFORMATION THROUGHPUT IN WIRELESS COMMUNICATION SYSTEMS

(75) Inventors: Aris L Moustakas, New York, NY (US); Hugo F Safar, Wesfield, NJ (US); Steven H Simon, Hoboken, NJ (US); Marin Stoytchev, Westfield, NJ (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/676,802

(22) Filed: Sep. 29, 2000

(51) Int. Cl.[7] ..... H01Q 21/00
(52) U.S. Cl. ..... 343/725; 343/893; 343/700 MS
(58) Field of Search ..... 343/700 MS, 725, 343/729, 853, 835, 872, 893, 844

(56) References Cited

U.S. PATENT DOCUMENTS 4,443,802 A * 4/1984 Mayes ..... 343/729
5,185,611 A * 2/1993 Bitter, Jr. ..... 343/702
5,654,724 A * 8/1997 Chu ..... 343/742
5,771,022 A 6/1998 Vaughan et al.
6,140,972 A * 10/2000 Johnston et al. ..... 343/725
6,154,175 A * 11/2000 Yee ..... 343/700 MS
6,181,279 B1 * 1/2001 Van Hoozen ..... 343/700 MS
6,239,750 B1 * 5/2001 Snygg ..... 343/700 MS
6,380,910 B1 * 4/2002 Moustakas et al. ..... 343/893

OTHER PUBLICATIONS

"Closely Spaced Monopoles For Mobile Communications", by R. G. Vaughan and N. L. Scott, *Radio Science,* vol. 28, No. 6, pp. 1259–1266, Nov.–Dec. 1993.

* cited by examiner

*Primary Examiner*—Don Wong
*Assistant Examiner*—Shih-Chao Chen
(74) *Attorney, Agent, or Firm*—John Ligon

(57) ABSTRACT

An integrated K-port antenna where K is an integer equal to 2 or greater and where the antenna is sufficiently small that it can be enclosed by K−1 overlapping spheres each having a diameter of $\lambda/2$ where $\lambda$ is equal to c/f and f represents an operating frequency of the antenna.

25 Claims, 4 Drawing Sheets

INTEGRATED MULTIPORT ANTENNA FOR ACHIEVING HIGH INFORMATION THROUGHPUT IN WIRELESS COMMUNICATION SYSTEMS

BACKGROUND OF THE INVENTION

1. Field of the Invention

The present invention generally relates to an integrated multiport antenna for increasing information rates of wireless communication networks.

2. Description of the Related Art

One of the more critical pieces of equipment in a communication network and, in particular, in a wireless communication network is the antenna. Antennas are used to convey information (i.e., transmit and receive information) in the form of electromagnetic waves over communication links of a network.

The owners and/or operators of communication networks, i.e., the service providers, are constantly searching for methods and equipment that can meet the changing needs of their subscribers. Subscribers of communication networks, including wireless communication networks, require higher information throughput in order to exploit the expanding range of services being provided by current communication networks. For example, wireless communication subscribers are now able to have simultaneous access to data networks such as the Internet and to telephony networks such as the Public Switched Telephone Network (PSTN). Also, service providers are constantly investigating new techniques that would allow them to increase their information throughput. Information throughput is the amount of information—usually measured in bits per second—successfully conveyed (transmitted and received) over a communication channel. Information throughput can be increased in a number of well known manners. One way is by increasing the power of the transmitted signals. A second way is by expanding the frequency range (i.e., bandwidth) over which the communication is established. However, both power and bandwidth are limited by certain factors such as governmental and standards organization that regulate such factors. In addition, for portable devices, power is limited by battery life.

An approach which circumvents the power and bandwidth limitations is to increase the number of antennas used to transmit and receive communication signals. Typically, the antennas are arranged as an array of antennas. Three of the more general ways of using antenna arrays are (a) phased array applications (b) spatial diversity techniques and (c) Multiple Input Multiple Output (MIMO) techniques. A phased array comprises an antenna array coupled to a device, which controls the relative phase of the signal in each antenna in order to form a focused beam in a particular direction in space. Spatial diversity is the selection of a particular antenna or a group antennas of the array to transmit or receive signals in order to improve information throughput. In a spatially diverse structure the antenna array is typically coupled to a receive diversity device that utilizes one of many combining techniques, such as Maximum Ratio Combining, switching, or many others well known to those skilled in the art. Unlike phased arrays and spatial diversity techniques wherein one or a group of antennas are used to transmit and/or receive a single signal, a technique called Multiple Input Multiple Output (MIMO) is used whereby the antenna array coupled to a signal processing device is used to transmit and/or receive multiple distinct signals. One example of a MIMO system is the BLAST (Bell Labs LAyered Space Time) system conceived by Lucent Technologies headquartered in Murray Hill, N.J.

In many cases, as the number of antennas in a transmit and/or receive array (e.g., BLAST system) is increased, the information throughput of the system also increases; G. J. Foschini and M. Gans, *Wireless Commun.* 6, 311 (1998). Typically the amount of space available for the antenna array is limited. In particular, the space limitation is very critical for portable wireless devices (e.g., cell phones, Personal Digital Assistants (PDA)). Thus, increasing the number of antennas in an array of limited space decreases the spacing between individual antennas in the array. The reduced spacing between antennas typically causes signal correlation to occur between signals received from different antennas. Signal correlation reduces the gain in information throughput obtained by the use of MIMO techniques; A. L. Moustakas et al., *Science* 287, 287 (2000).

In particular, received signal correlation is a phenomenon whereby the variations in the parameters (i.e., amplitude and phase) of a first signal of a first antenna track the variations in the parameters of a second signal of a second antenna in the vicinity of the first antenna; *Microwave Mobile Communications,* W. J. Jakes (ed.), chapter 1, IEEE Press, New York (1974). Correlation is quantitatively defined in terms of at least two signals. When any two signals $s_1(t)$ and $s_2(t)$ are being transmitted or received, the degree of correlation between these two signals is given by the absolute value of the following expression:

$$\frac{\int_{t_1}^{t_2} s_1(t)s_2(t)*dt}{\sqrt{\int_{t_1}^{t_2}|s_1(t)|^2\,dt\int_{t_1}^{t_2}|s_2(t)|^2\,dt}}$$

where $s_2^*(t)$ corresponds to the complex conjugate of $s_2(t)$ and $t_1$ and $t_2$ are times selected in accordance to rules well known to those skilled in the pertinent art. When two signals have low correlations or are uncorrelated, the above integral becomes relatively-small.

The correlation between received signals can be determined by the correlation of the radiation patterns of the antennas receiving the signals. As it is known to those skilled in the art, the radiation pattern of a particular antenna or cluster of antennas fed through a port, is the relative amplitude, direction and phase of the electromagnetic field in the far field region radiated at each direction. The radiation patterns are reciprocal in that they show the relative amplitude, phase and direction of a field transmitted from an antenna as well as the sensitivity of that antenna to incoming radiation from the same direction. The radiation pattern can be measured experimentally in an anechoic chamber, or calculated numerically with the use of a programmed computer.

The correlation function of two radiation patterns is a useful measure of the degree of their overlap. It is defined as the magnitude of $$\frac{\int dk\vec{E}_1(k)\cdot(\vec{E}_2(k))^*}{\sqrt{\int dk|\vec{E}_1(k)|^2\int dk|\vec{E}_2(k)|^2}}$$

where $E_1(k)$ and $E_2(k)$ are the far field vector electric fields at direction k of the radiated field at a given frequency due to ports 1 and 2 respectively and $E_2(k)^*$ is the complex conjugate of the far field vector electric field at direction k due to port 2. The correlation between radiation patterns can be calculated based on the experimentally determined or numerically calculated individual-radiation patterns.

When two antennas are placed sufficiently far from each other, the correlation of their radiation patterns at the same frequency will be very small. A result of this effect is that the received signal from two antennas spaced sufficiently apart will be independent. The radiation pattern of a port of an antenna generally depends on many factors. A port is a part of the antenna at which a signal is applied to produce electromagnetic radiation or a point on the antenna from which a signal is obtained as the result of electromagnetic radiation impinging on the antenna. The factors affecting the radiation pattern of a port of an antenna include the placement of the port, the materials from which the port and antenna are constructed, structure and shape of the antenna, the relative position of the antenna in an antenna array, the relative position of the antenna within a communications device, as well as the position of other objects proximately spaced to the antenna. The reason for this dependence is the electromagnetic coupling of the antenna to nearby objects. In general, electromagnetic coupling of an antenna to other objects or other antennas can modify the radiation pattern of one or more of the ports of the antenna.

The radiation pattern at a particular frequency of a particular port of a particular antenna in a particular antenna array has several well known characteristics. One such characteristic is a node or a null. A node or a null is a direction in space where the transmitted (or received) radiation power is zero or relatively small, i.e., more than 20 dB below the average radiated power. Another property is a lobe which is a direction in space where the radiated power has a 'local maximum'. A direction in space where the radiated power is at its highest measured value (commonly referred to as 'absolute maximum') is called the main lobe of the port. A lobe generally has a width, corresponding to the directions around it that have appreciable radiated power. The width of the lobe is defined as the set of directions in the immediate neighborhood of the lobe maximum which has a radiated power of more than half the radiated power of lobe maximum. Also, two lobes from two different radiation patterns at the same frequency are considered as not overlapping if their respective widths do not overlap.

It is useful to describe the radiation pattern in terms of the radiation pattern of an ideal dipole antenna since many antennas have patterns that are similar to those of dipole antennas. A dipole radiation pattern is defined to have a null in two opposite collinear directions and a peak radiated power in the plane perpendicular to the collinear direction, with the power in that plane fluctuating by no more than 5 dB. Such a radiation pattern is said to be polarized along the axis of the nulls. When two ports of an antenna have dipole radiation patterns that have null axes with relative angles higher than 20 degrees, the antenna is dually polarized a given frequency when only these 2 ports are operating at that frequency. If the dually polarized antenna has axes with relative angles between 70 and 110 degrees, it is said to be cross-polarized. Similarly, if m ports of an antenna, with m greater or equal to 3, have dipole radiation patterns, such that any two axes have a relative angle greater than 20 degrees, then the antenna is m-fold polarized at a given frequency when all m ports are operating at that frequency.

Typically the antennas are at least on the order of a wavelengh-apart. A wavelength of a signal is the ratio of the speed of light in vacuum to the frequency of the signal. For example a signal having a frequency of f has a wavelength $\lambda$ equal to c/f where c is a well known physical constant representing the speed of light in vacuum which is approximately $$3\times10^8\ \frac{\text{m}}{\text{sec.}}.$$

It is well known that the correlation between received signals of approximately placed antennas increases as the antennas are placed closer to each other; *Microwave Mobile Communications,* W. J. Jakes (ed.), chapter 1, IEEE Press, New York (1974). In the case of two antennas receiving signals, as the signals being received by the antennas become more correlated, the use of the second antenna becomes essentially redundant; this is because both antennas are receiving, in essence, the same information since the information carried by a signal is typically encoded with the variations in one or more parameters, (i.e., amplitude, phase) of a signal. Conversely, when the signals being received from the different antennas are uncorrelated, the signals are independent of each other and therefore the antenna system can receive information up to twice the information rate of one antenna alone; G. J. Foschini and M. Gans, *Wireless Commun.* 6, 311 (1998).

It is also well known that in order to avoid the type of correlation that render one or more nearby antennas redundant, the distance between the antennas should be at least $\lambda/2$ where $\lambda$ is equal c/f to is the wavelength corresponding to the largest frequency f within a band of frequencies being used for communication by the antennas; *Microwave Mobile Communications,* W. J. Jakes (ed.), chapter 1, IEEE Press, New York (1974). The need to,have a group of antennas or an array of antennas situated in a relatively small space, while maintaining a relatively low degree of antenna correlations, is a critical problem for many communication devices, particularly wireless mobile communication devices.

One approach that has been proposed for packing many antennas into a small space is to construct an array of individual antennas; Vaughan et al., U.S. Pat. No. 5,771,022; "Closely Spaced Monopoles for Mobile Communications", Rodney G. Vaughan and Neil L. Scott, *Radio Science* vol. 28, Number 6, Pp 1259–1266 (1993). In this antenna array approach, several individual antennas with various desirable engineering properties (e.g., high gain, lightweight, small, manufacturable), are assembled into an antenna array. It is found that under certain circumstances individual antennas can be spaced a small fraction of $\lambda$ (less than 0.2 $\lambda$, for example) and due to the electromagnetic coupling between the antennas, the correlation between signals received at the two antennas can remain smaller than 0.7. The antenna array approach, however, has several disadvantages. One disadvantage is that the available space on a mobile device or any other device may not be shaped to allow an array of individual antenna elements to be positioned therein. In addition, construction of antenna arrays from individual antenna elements may result in other undesirable features of the antenna array including poor gain, low durability, or relatively high manufacturing costs. More generally, the problem associated with f constructing antenna arrays is that the variety of antenna arrays that one can fashion out of composites of individual antennas is limited which therefore limits the flexibility in designing such antenna arrays for communication devices.

What is therefore needed is an antenna used for various applications including wireless communication applications where such an antenna device: (a) occupies a relatively small volume of space, (b) maintains low correlations between the different signals transmitted and/or received by such a device and (c) enables great flexibility in design–allowing a large variety of shapes and structures so that the antenna design satisfies various engineering constraints (e.g., size, desired shape, manufacturing costs).

SUMMARY OF THE INVENTION

The present invention provides an integrated multi-port antenna that occupies a relatively small volume and is capable of transmitting and/or receiving uncorrelated signals for achieving high information throughput. Further, the integrated nature of the structure allows great flexibility in design for satisfying various engineering requirements such as size, shape, ease of manufacture and durability.

In particular, the present invention provides method and apparatus for an integrated K-port antenna where K is an integer equal to 2 or greater where the antenna can be enclosed by K−1 overlapping spheres each having a diameter $\lambda/2$ where $\lambda$ is equal to c/f and f is the lowest frequency component of a range of frequencies within which each of the ports operates. The correlation between the radiation patterns produced by any two ports is less than 0.7

In a preferred embodiment, non metallic materials with relatively high dielectric constants are used to allow the construction of K-port antennas of smaller size with improved radiation characteristics.

DETAILED DESCRIPTION

Figure 1A:
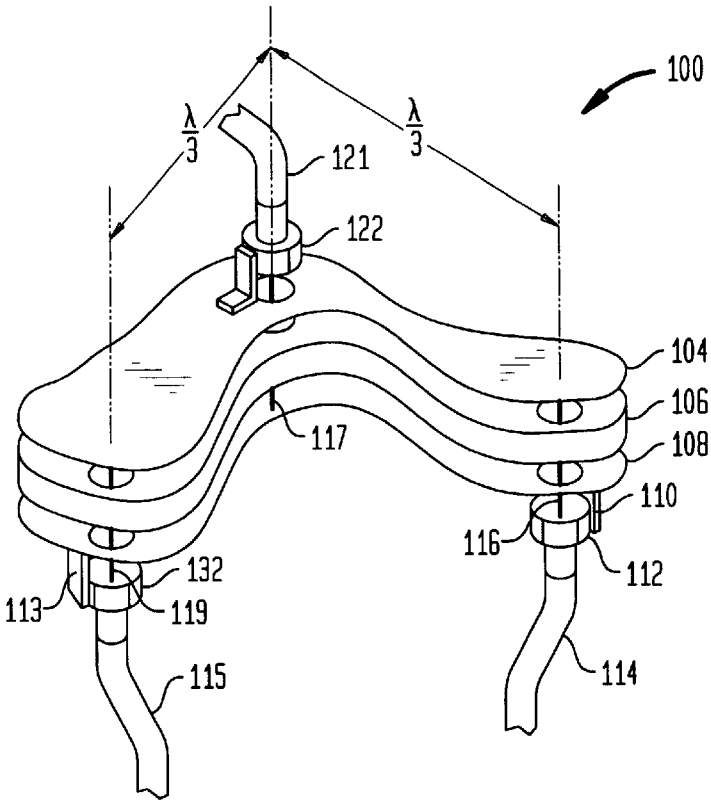
FIG. 1A is an exploded perspective view of a particular embodiment of the integrated multiport antenna of the present invention.

The apparatus of the present invention is an integrated K-port antenna where K is an integer equal to 2 or greater and the antenna can be enclosed by K-1 overlapping spheres each having a diameter of $\lambda/2$ where $\lambda$ is equal to c/f and f is the lowest frequency component of a range of frequencies within which each of the ports operates. An integrated K-port antenna is single piece structure limited in size such that K-1 overlapping spheres encompass the entire K-port antenna. The spheres overlap such that each of the K-1 spheres has at least one common point with at least one other sphere.

The K-port antenna of the present invention thus can be situated within the space defined by K-1 such overlapping spheres.

A multiple port antenna is an antenna having two or more ports that are able to transmit and/or receive electromagnetic signals. Each of the ports of the antenna, when operating at a particular frequency, provides a radiation pattern representing the relative amplitude levels and phase values of the electromagnetic waves being received and/or transmitted by the antenna along different directions. The shape of the antenna and the relative positioning of its ports to each other are adjusted such that the main lobes of the respective radiation patterns face in different directions. Further, the shape of the antenna and the relative positioning of its ports to each other are adjusted such that the correlation between any two radiation patterns from any two ports is less than 0.7. The integrated multiport antenna of the present invention comprises metallic and non metallic parts. These non metallic parts are made of material having a dielectric constant $\epsilon>2$ at the frequency range within which the antenna is operable. The use of such non-metallic. materials allows for a relatively small antenna volume meeting the size constraints discussed above. As a result, the antenna can occupy relatively small volume without the respective signals at different ports being significantly correlated to each other, and can be used to transmit and/or receive independent signals simultaneously. The antenna of the present invention is be sufficiently small so that K-1 overlapping spheres with diameter of $\lambda/2$ can encompass the entire antenna. Further, in some configurations, it is possible to have the entire K-port antenna be enclosed by K-1 spheres each having a diameter of 0.4 $\lambda$. Also, in some configurations, it is possible to have the entire K-port antenna be enclosed by K-1 spheres each having a diameter of 0.3 $\lambda$. Even further, in some configurations, it is possible to have the entire K-port antenna be enclosed by less than K-1 spheres each having a diameter of 0.5 $\lambda$. Independent operation occurs when the ports can receive and/or transmit signals that do not track each other.

Embodiments of the K-port antenna of the present invention comprise an antenna having at least two of the ports that provide radiation patterns that are not cross polarized.

Another embodiment of the antenna of the present invention has at least two ports that are, used to transmit at least two signals where, any two of the signals have a correlation of less than 0.95.

An antenna is said to be operating when at least one port of the antenna is transmitting and/or receiving electromagnetic signals. Each of the ports of the antenna of the present invention is designed to operate at a particular frequency called the resonant frequency. However, each of the ports of the antenna of the present invention actually operates within a range of frequencies one of which is the designated resonant frequency.

Figure 1B:
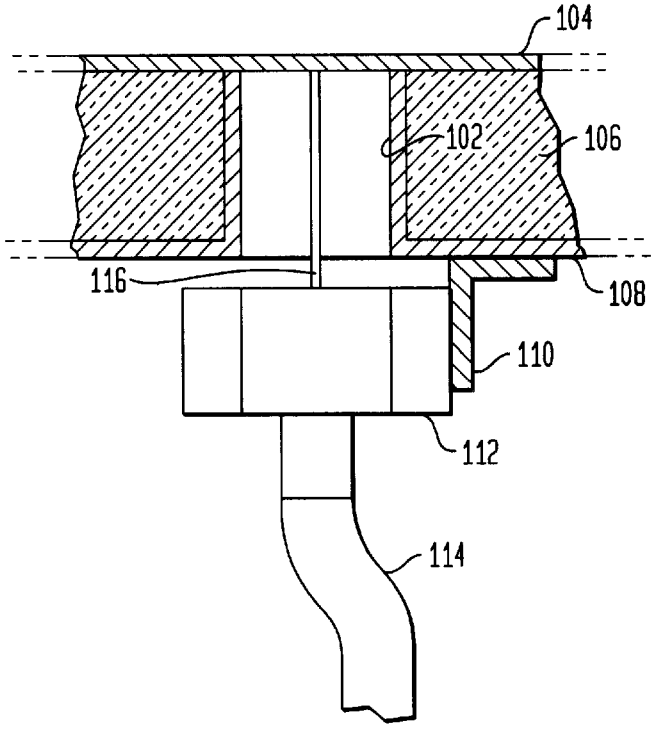
FIG. 1B is a side view of a port of the antenna of FIG. 1A.

FIGS. 1A and 1B show an exploded perspective view and a side view respectively of a first preferred embodiment of the present invention where K=3. Antenna 100 is thus a three port integrated antenna. It is noted that the integrated multiport antenna of the present invention is not limited to any particular shape, number of ports, or construction detail. Antenna 100 comprises dielectric material 106 positioned between and making contact with metallic layers 104 and 108. The dielectric material used for antenna 100 and other antennas used to construct the antenna of the present invention is preferably non-metallic with dielectric constant greater than 2. Layers 104 and 108 are electrically coupled to each other via metallic coupling element 102. Antenna 100 is driven by an electrical signal through coaxial cable 114, which is connected to the antenna by means of SMA connector 112. A central male pin connector 112 (not shown) is in mating contact with metallic female pin 116 of the antenna which extends from metallic layer 104 through openings in metallic layer 108 and dielectric material 106. SMA connector 112 and coaxial cable 114 are not considered part of the, antenna of the present invention. SMA connector 112 is attached to metallic layer 108 via metallic contact 110. Antenna 100 is drawn with three SMA connectors (112, 122, 132) each is coupled to one of the ports of the antenna. Thus, each port of the antenna comprises a female pin (116, 119, 117) extending from one of the metallic layers through the dielectric material 106 and through an opening in the other metallic layer. SMA connector 122 has male pin (not shown) matingly connected to female pin 117. SMA connector 122 is attached to metallic layer 104 via metallic contact 111. SMA connector 132 has it male pin (not shown) matingly connected to female pin 119. SMA connector 132 is attached to metallic layer 108 via metallic contact 113. It is also possible to have the male pin of the SMA connectors extend through a metallic layer and dielectric layer 106 to be in attachment with the other metallic layer; in this manner the male pin (not shown) extending from the connector can be soldered in some other way attached to one of the metallic layers. In the embodiment shown in FIGS. 1A and 1B the size of the antenna device is chosen such that the distance between pin 116 and pin 117 is $\lambda/3$ (where $\lambda$ is the electromagnetic wavelength equaling to c/f and f is the lowest frequency component of a range of frequencies within which this three port antenna operates. As an example, we consider a target resonance frequency equal to 2.5 GHz which then yields a wavelength of approximately 12 cm and thus $\lambda/3$ is approximately 4 cm. Similarly, the distance between pin 117 and pin 119 is also $\lambda/3$. The total size of this embodiment of an integrated three port antenna is sufficiently small such that, not including the external cables 114, 115 and 121, it can be entirely enclosed within two imaginary overlapping spheres each having a diameter of $\lambda/2$. One such imaginary sphere is located so that its center is halfway between pins 116 and 117 and the other sphere is located so that its center is located halfway between pins 117 and 119. As illustrated, the ports may or may not be in the same plane and/or direction. Also, the metallic layers 104 and/or 108 may or may not be electrically continuous. Furthermore, the overall design of the antenna may or may not be planar. It is understood that the electromagnetic properties of this three port antenna are may be quite different from what could be obtained by bringing together three individual antennas.

The integrated multiple port antenna of the present invention can be linear, planar or three dimensional, in the sense that the ports of the antenna may lie on a straight line, a plane or in a three dimensional space. It will be readily understood that the antenna is mounted on a support mechanism (not shown). Further, not all of the ports of the antenna have to be operating; the present invention is not limited to a multiple port antenna in which all of the ports are operating at some frequency falling within a range of frequencies that define the bandwidth of the K-port antenna. At any instant in time, some or all of the ports may not be operating.

Figure 2A:
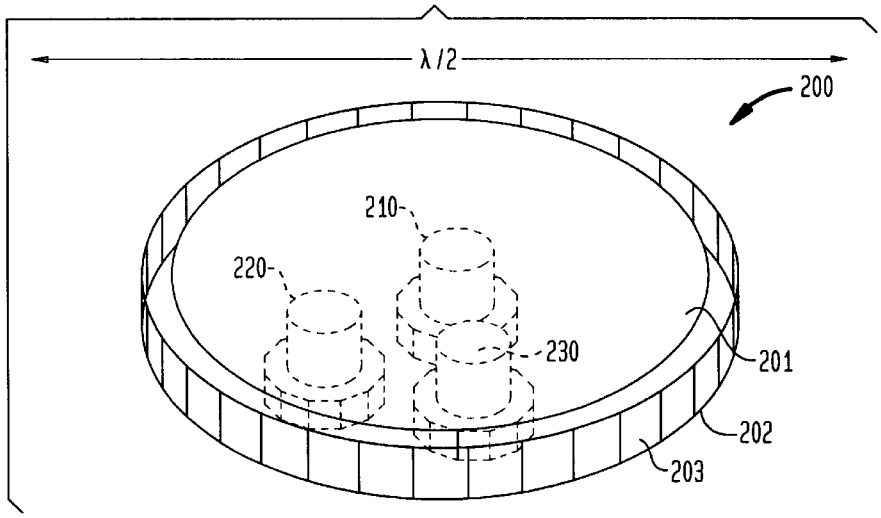
FIG. 2A is a perspective view of another embodiment of the integrated multiport antenna of the present invention.

A second preferred embodiment of an integrated multiport antenna 200 is shown in FIG. 2A. This particular embodiment is a circular and planar integrated three port antenna. It is to be understood that although this embodiment is circular and planar, the general invention may take any arbitrary shape and, may or may not be planar. In this embodiment, the three ports, 210, 220, and 230 are placed in an equilateral triangle whose center is also the center of the circular multiport antenna. Each port comprises openings in the ground plane metallic layer 202 and a connecting assembly connected to such openings as discussed below. A side view of port 230 is shown in FIG. 2C. It will be readily understood that the particular port shown in FIG. 2C is for illustrative purposes only. The port design of this embodiment of the invention is certainly not limited to that shown in FIG. 2C. Returning to FIG. 2A, a circular metallic top plate 201 covers the circular dielectric layer 203, which is on top of a metallic circular ground plane 202. Metallic circular ground plane 202 has openings at the location of the ports. In FIG. 2C, a connecting assembly comprising female pin 231, insulating material 234 and threaded coupling device 232 is constructed to mate with an SMA connector having a male pin that is part of a coaxial cable. Female pin 231 is connected to top plate 201 while ground plane 202 is connected to threaded coupling device 232 of the connecting assembly. Dielectric layer 203 has, hole 233 at the location of the ports as shown in FIG. 2C. Insulating material 234 is surrounds female pin 231 as shown. Port 230 can also be designed with a coaxial cable having a male pin that extends through ground layer 203 and attached to metallic layer 201 through well known means. In another version of the connecting assembly shown at port 230, the outer portion of an SMA connector (with a male pin) is attached to grounded metallic layer 202 via a metallic contact in the exact manner as shown in FIG. 1B with corresponding connector 112 and metallic contact 110. The male pin extending from the SMA connector is soldered or otherwise adhered to metallic layer 201.

Still referring to FIG. 2A, it is to be understood that the ports 210 and 220 are designed similarly to port 230; in general the ports of a multiport antenna may be designed differently. The dielectric layer 203 has a dielectric constant of 4 for this particular embodiment. FIG. 2A includes a measuring scale indicating the size of the wavelength $\lambda$ corresponding to the frequency of operation of the antenna. It is thus shown that the overall size of the multiport antenna is sufficiently small such that it can be enclosed within a single sphere of diameter $\lambda/2$ centered with the center of the device; the device can also be enclosed by two such spheres.

Figure 2B:
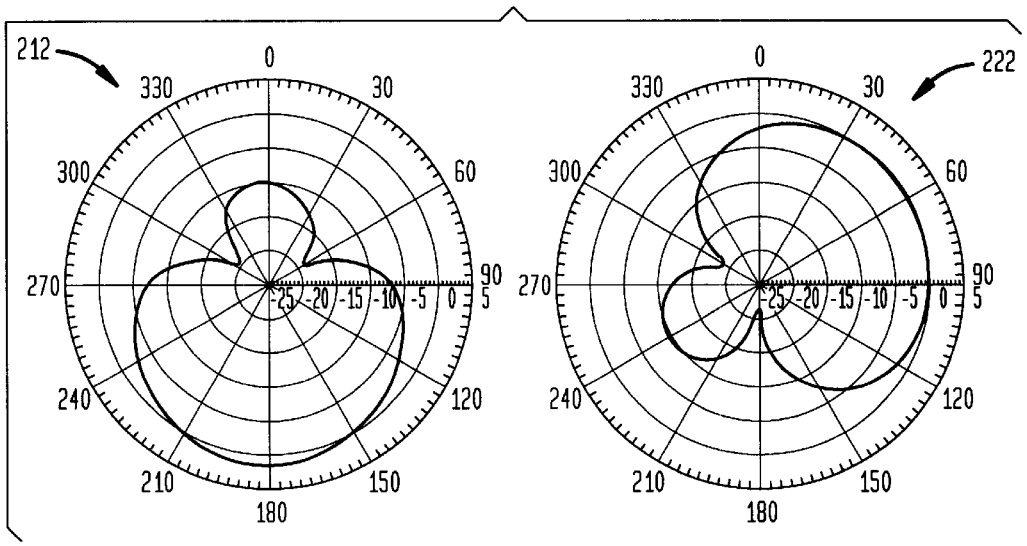
FIG. 2B shows the radiation patterns from two different ports of the antenna of FIG. 2A.
Figure 2C:
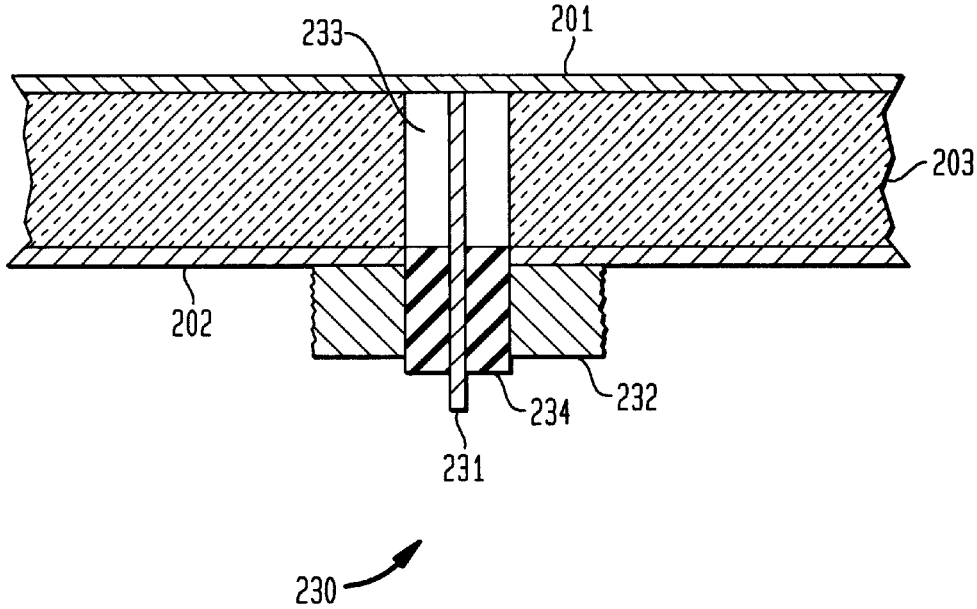
FIG. 2C is a side view of a port of the multiport antenna of FIG. 2A.

Referring now to FIG. 2B, the radiation pattern 212 corresponding to port 210 of the integrated three-port antenna 200 of FIG. 2A is shown. Radiation pattern 212 has a main lobe facing the 186 degree direction. Radiation pattern 222 corresponding to port 220 of the integrated multiport antenna 200 of FIG. 2A is also shown in FIG. 2B. Both radiation patterns have been calculated using a programmed computer. It is to be understood these radiation patterns can also be generated from actual measurement of a multiport antenna or a device containing a multiport antenna. Radiation pattern 222 has a main lobe facing the 60 degree direction. The radiation pattern (not shown) due to port 230 is similar except that it would have a main lobe facing the 300 degree direction. Thus, the main lobes of the three ports point in different directions; this makes the signals received transmitted from any two of the three ports have relatively low correlations.

The integrated multiple port antenna of the present invention can be coupled or connected in a well known fashion to a wireless communication device (e.g., cell phone, wireless laptop computer, Personal Digital Assistant (PDA)) to enable such device to increase its information throughput. Further the integrated multiple port antenna of the present invention can be coupled or connected to radio transceivers to form a wireless communication device.

The integrated multiple port antenna of the present invention is typically located in a multipath scattering environment. A multipath scattering environment is a physical surrounding with many scatterers (e.g. buildings, people, cars, trees) in which electromagnetic waves travel from one point (e.g. of a transmitter antenna) to another (e.g. a point on a receiver antenna) after being scattered (e.g. reflected or diffracted) at least once. If the radiation patterns of any two or more ports of the antenna of the present invention operating at a given frequency are not correlated or have relatively small correlations, two or more independent signals can be transmitted and/or received rough these ports at the given frequency in a multipath environment. A wireless communication device connected to the antenna of the present invention is thus able to achieve relatively high data transmission rates.

Figure 3:
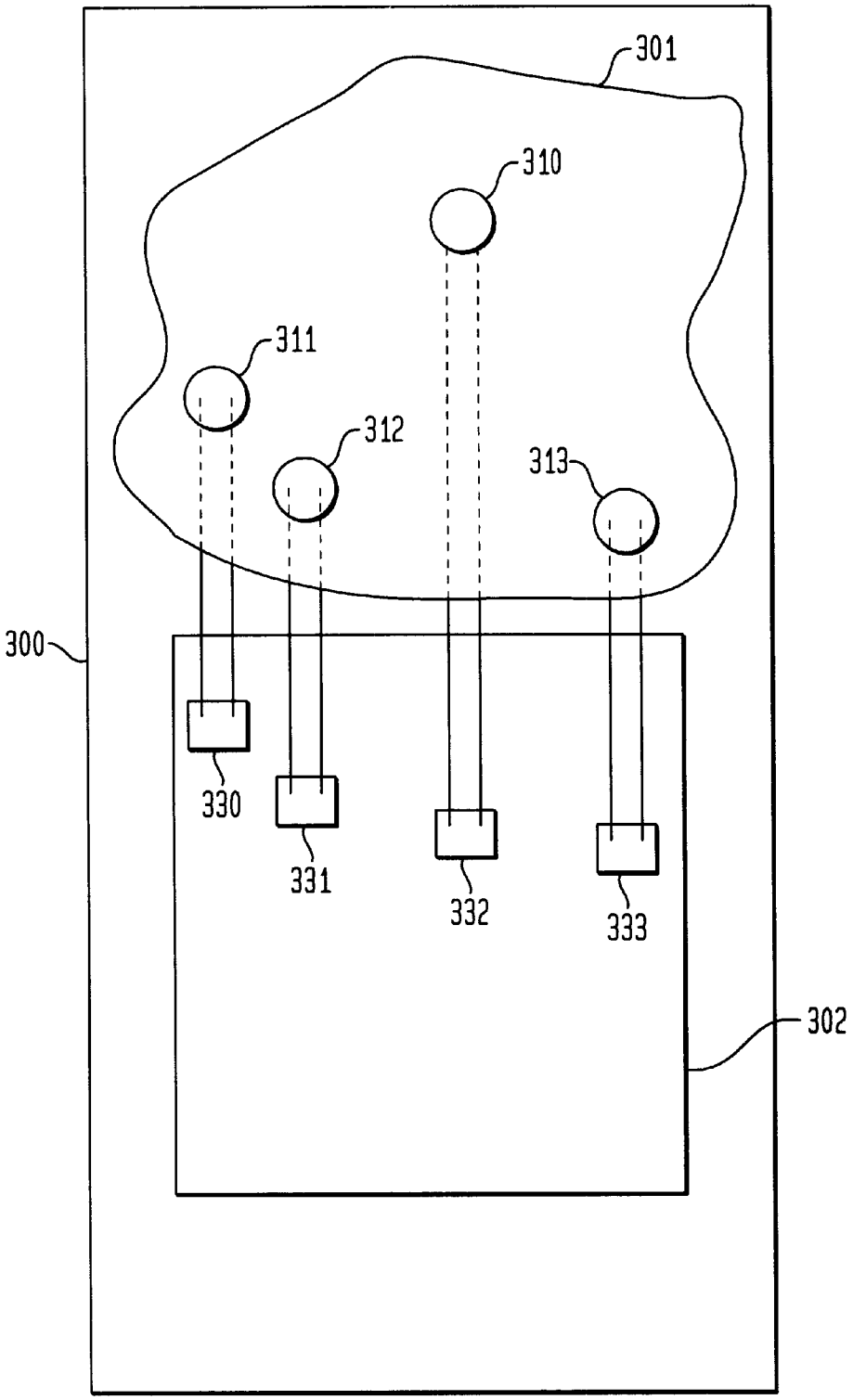
FIG. 3 shows an integrated muitiport antenna coupled to a wireless communication device.

FIG. 3 depicts a schematic representation of a particular embodiment of a wireless communication device 300 comprising an integrated multiport antenna 301 and at least two radio transceivers (not shown) coupled to the ports of the antenna. A transceiver is a component of the device that can receive and or transmit signals. Further, a signal combining/processing 302 device can also be coupled to the K-port antenna. The K-port antennas of FIGS. 1 or 2 can be used for the communication device of FIG. 3. The integrated multiport antenna has four ports 310, 311, 312, and 313. The ports 310, 311, 312, and 313 of the multiport antenna are coupled to four input/output connections 330, 331, 332, and 333 of the signal combining/processing device 302. It should be noted that the present invention is not restricted to the quantity, length and shape of the connectors connecting integrated antenna 301 to signal combining/processing device 302. The wireless communication device comprising an integrated multiport antenna and a signal combining/processing device may have any number of ports equal to or greater than two. Also the corresponding connectors between the antenna and the signal combining/processing device may have any arbitrary length and/or shape, or may not be used at all (i.e., the antenna is connected to the signal combining/processing device in a plug in fashion). Depending of the intended use of the wireless communication device, the signal combining/processing device 302 can be a phase controlling device, a receive diversity combining device, or a MIMO signal processing device. A MIMO combining/processing device may comprise at least two radio transceivers, connected to the ports of the antenna, and a MIMO signal combining/processing device that allows the decoding more than one distinct signal where the radio transceivers can transmit and/or receive at least two independent signals at the operating frequency. It should be noted that the antenna can be used for transmission and/or reception. It should also be noted that the communication device can have any size relative to the wavelength of the operating frequency f.

According to the method of the present invention, the radiation patterns associated with each of the ports of the multiport antenna of the present invention can be measured or calculated by techniques that are well known to hose skilled in the art. An iterative procedure of providing a structure for the K-port antenna comprises the steps of determining the resulting radiation pattern for each of the ports and modifying the size shape and overall structure of the antenna such that each of the ports provides a radiation pattern having a main lobe pointing in a direction different from any other main lobe can be used to achieve the desired performance of the antennas. Each modification of the antenna structure is followed by measurements and/or calculations of the resulting radiation patterns from the ports and the correlation between signals received or transmitted by the ports until the desired performance characteristics of the antenna alone is achieved or the desired performance characteristics of the antenna coupled to a communication device is achieved. For example, the structure can be modified such that the radiation patterns from any two ports have a radiation pattern that is below 0.7.

We claim:

1. An integrated K-port antenna where K is an integer equal to 2 or greater, where ports of the antenna have a radiation pattern determined by the shape of the antenna and the positioning of the K-ports relative to each other, and at least 2 of the ports are arranged to transmit and receive independent signals at a common frequency, and further wherein the positioning of the ports is such that the antenna can be enclosed by K-1 overlapping spheres each having a maximum diameter of $\lambda/2$, where $\lambda$ is equal to c/f and f represents an operating frequency of the antenna.

2. The antenna of claim 1 where K is equal to 3 or greater.

3. The antenna of claim 1 where each of the K-1 overlapping spheres have diameter $0.4\lambda$.

4. The antenna of claim 1 where each of the K-1 overlapping spheres have diameter $0.3\lambda$.

5. The antenna of claim 1 where at least two of the ports provide radiation patterns that are not cross polarized.

6. The antenna of claim 1 where any two ports provide radiation patterns having main lobes that face different directions.

7. The antenna of claim 1 where any two ports provide radiation patterns which have a correlation of less than 0.7 between them.

8. The antenna of claim 1 where there exists at least one non-metallic part of the antenna which has a dielectric constant greater than 2.

9. The antenna of claim 1 where at least two of the ports are used to transmit at least two signals where any two of the signals have a correlation of less than 0.95.

10. A wireless communication device comprising:

an integrated K-port antenna where K is an integer equal to 2 or greater, where ports of the antenna have a radiation pattern determined by the shape of the antenna and the positioning of the K ports relative to each other, and at least 2 of the ports are arranged to transmit and receive independent signals at a common operating frequency, and further wherein the positioning of the ports is such that the antenna can be enclosed by K-1 overlapping spheres each having a maximum diameter of $\lambda/2$, where $\lambda$ is equal to c/f and f represents an operating frequency of the antenna; and at least two radio transceivers, connected to ports of the antenna, where the radio transceivers can transmit and/or receive at least two independent signals at the common operating frequency.

11. The wireless communication device of claim 10 where K is equal to 3 or greater.

12. The wireless communication device of claim 10 where each of the K-1 overlapping spheres have diameter $0.4\lambda$.

13. The wireless communication device of claim 10 where each of the K-1 overlapping spheres have diameter $0.3\lambda$.

14. The wireless communication device of claim 10 where at least two of the ports of the K-port antenna provide radiation patterns that are not cross-polarized.

15. The wireless communication device of claim 10 where any two ports of the K-port antenna provide radiation patterns having main lobes at face different directions.

16. The wireless communication device of claim 10 where any two ports of the K-port antenna provide radiation patterns which have a correlation of less than 0.7 between them.

17. The wireless communication device of claim 10 where there exists at least one non metallic part of the device which has a dielectric constant greater than 2.

18. The wireless communication device of claim 10 where at least two of the ports of the K-port antenna are used to transmit at least two signals where any two of the signals have a correlation of less than 0.95.

19. The wireless communication device of claim 10 further comprising a receive diversity combining device coupled to the K-port antenna.

20. The wireless communication device of claim 10 further comprising a phase controlling device coupled to the K-port antenna.

21. The wireless communication device of claim 10 further comprising a MIMO signal processing device coupled to the K-port antenna to decode more than one distinct signals.

22. A method of designing an integrated K-port antenna comprising the steps of:

providing a structure for the K-port antenna;

determining a resulting radiation pattern for each of the ports; and modifying the shape of the antenna and the positioning of the K-ports relative to each other such that each of the ports provides a radiation pattern having a main lobe pointing in a different direction and arranging for at least two of the K-ports to be operable to transmit and receive independent signals at a common operating frequency.

23. The method of claim 22 where the step of determining a radiation pattern comprises the step of measuring the radiation patterns.

24. The method of claim 22 where the step of determining a radiation pattern comprises the step of using a programmed computer to calculate the radiation, pattern.

25. The method of claim 22 where the step of modifying comprises the step of modifying the shape of the antenna and the positioning of the K ports relative to each other such that the radiation pattern is from any two ports have a correlation that is below 0.7.

* * * * *